US007497150B1

(12) United States Patent
Huang

(10) Patent No.: US 7,497,150 B1
(45) Date of Patent: Mar. 3, 2009

(54) PLIERS FOR C OR E-SHAPED FASTENERS

(76) Inventor: Chun-Chia Huang, No. 23, Lane 778, Taiping Rd., Taiping City, Taichung Hsien (TW)

( * ) Notice: Subject to any disclaimer, the term of this patent is extended or adjusted under 35 U.S.C. 154(b) by 0 days.

(21) Appl. No.: 12/007,175

(22) Filed: Jan. 8, 2008

(51) Int. Cl.
*B25B 7/02* (2006.01)

(52) U.S. Cl. ..... 81/423; 81/302

(58) Field of Classification Search ..... 81/423, 81/302, 185.1, 178
See application file for complete search history.

(56) References Cited

U.S. PATENT DOCUMENTS 753,456 A * 3/1904 Weidinger ..... 7/133
5,884,540 A * 3/1999 Mo ..... 81/423
6,551,316 B1 * 4/2003 Rinner et al. ..... 606/57
7,007,357 B2 * 3/2006 Nakamoto ..... 29/229
7,032,479 B1 * 4/2006 Wang ..... 81/302
7,055,413 B1 * 6/2006 Wang ..... 81/302

* cited by examiner

*Primary Examiner*—David B Thomas
(74) *Attorney, Agent, or Firm*—Posz Law Group, PLC

(57) ABSTRACT

A pair of pliers has two bodies, a pair of heads and two connection devices. The bodies are pivotally connected with each other, and each body has a handle and a shank formed respectively at two ends of the body. The heads are detachably attached respectively to the shanks of the bodies. The connection devices are mounted between the heads and the shanks to detachably connect the heads to the shanks. Each connecting device has a connection block and a connection loop. The connecting block is formed on one of the heads and shanks. The connecting loop is formed on a corresponding one of the heads and shanks and securely and is detachably mounted around the connecting block. Accordingly, the pair of pliers is easily changeable for different heads.

10 Claims, 7 Drawing Sheets

PLIERS FOR C OR E-SHAPED FASTENERS

BACKGROUND OF THE INVENTION

1. Field of the Invention

The present invention relates to a pair of pliers, and more particularly to a pair of pliers for C or E-shaped fasteners and easily changeable for different heads.

2. Description of Related Art

With reference to FIG. 7, a pair of conventional pliers for a C or E-shaped fasteners in accordance with the prior art comprises two bodies (60,62) and two heads (70). The bodies (60,62) are pivotally connected with each other, and each body (60,62) has a shank (602,622). The heads (70) are securely attached respectively to the shanks (602,622) of the bodies (60,62) with bolts (72) or screws, and each head (70) has a tip.

In operation, the tips on the heads (70) are inserted into holes in a C or E-shaped fastener. When the bodies (60,62) are pushed or pulled, the shanks (602,622) with the heads (79) are expanded from each other to expand the C or E-shaped fastener. Consequently, the C or E-shaped fastener can be attached to or removed from an object. Because the heads (70) are securely attached to the shanks (602,622) with bolts (72), the heads (70) on the bodies (60,62) are changeable to fit with different working situations.

However, to change different heads (70) onto the bodies (60,62) needs a tool, such as a screwdriver to unscrew the bolts (72), so this is time consuming and troublesome.

To overcome the shortcomings, the present invention tends to provide a pair of pliers to mitigate or obviate the aforementioned problems.

SUMMARY OF THE INVENTION

The main objective of the invention is to provide a pair of pliers for C or E-shaped fasteners and easily changeable for different heads.

The pair of pliers comprises a first body, a second body, a pair of heads and two connection devices. The first body has a handle and a shank formed respectively at two ends of the first body. The second body is pivotally connected with the first body and has a handle and a shank formed respectively at two ends of the second body. The heads are detachably attached respectively to the shanks of the first and second bodies. The connection devices are mounted between the heads and the shanks to detachably connect the heads to the shanks. Each connecting device comprises a connection block and a connection loop. The connecting block is formed on one of the heads and shanks. The connecting loop is formed on a corresponding one of the heads and shanks and securely and is detachably mounted around the connecting block.

Other objects, advantages and novel features of the invention will become more apparent from the following detailed description when taken in conjunction with the accompanying drawings.

DETAILED DESCRIPTION OF PREFERRED EMBODIMENT

Figure 1:
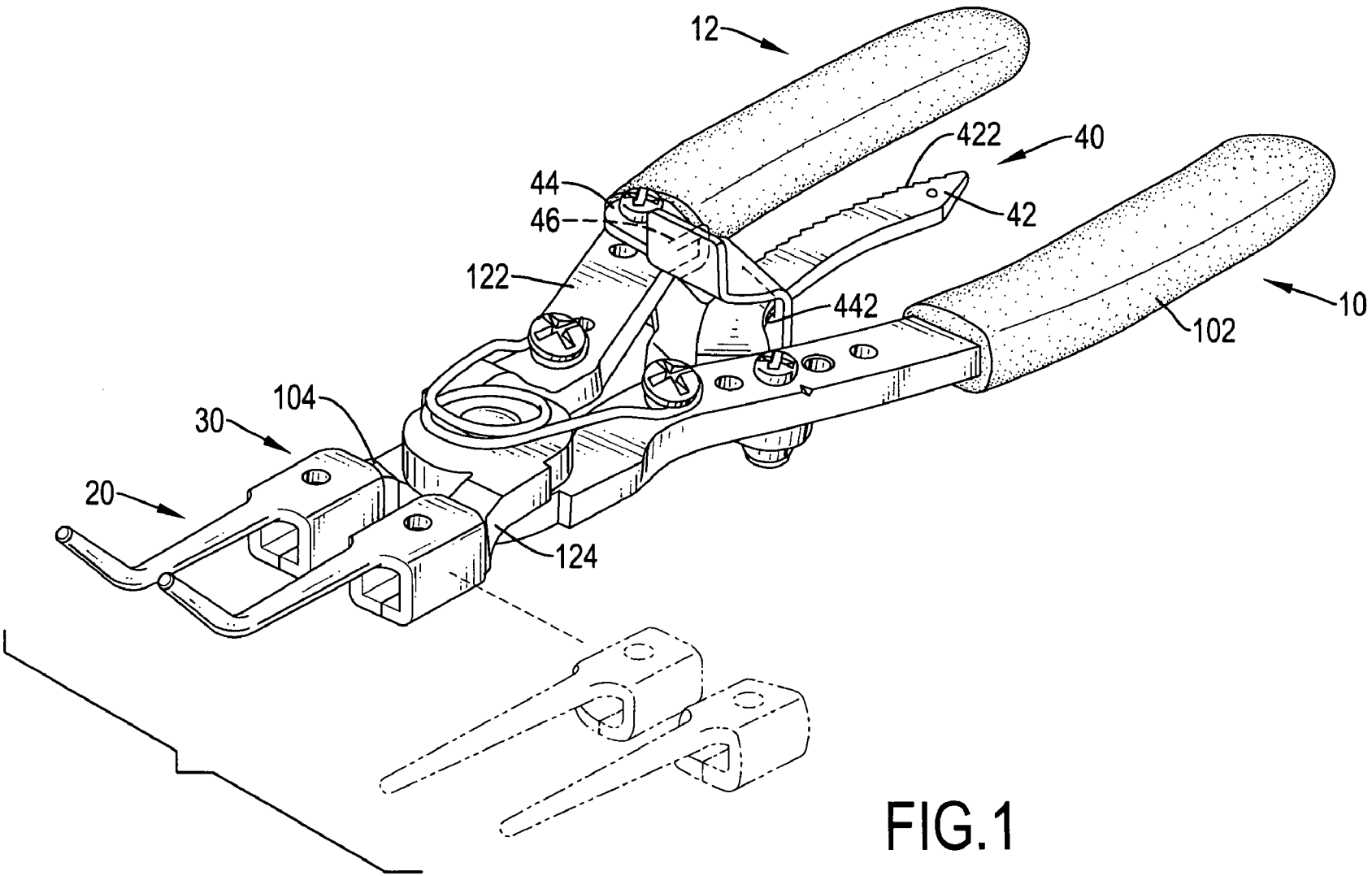
FIG. 1 is a perspective view of a pair of pliers in accordance with the present invention with phantom lines showing that heads are changeable.

With reference to FIG. 1, a pair of pliers in accordance with the present invention comprises a first body (10), a second body (12), a pair of heads (20) and two connection devices (30). The first body (10) has a handle (102) and a shank (104) formed respectively at two ends of the first body (10). The second body (12) is pivotally connected with the first body (10) and has a handle (122) and a shank (124) formed respectively at two ends of the second body (12).

The heads (20) are detachably attached respectively to the shanks (104,124) of the first and second bodies (10,12) with the connection devices (30). The heads (20) may have bent or straight tips to fit with different fasteners or working situations.

Figure 2:
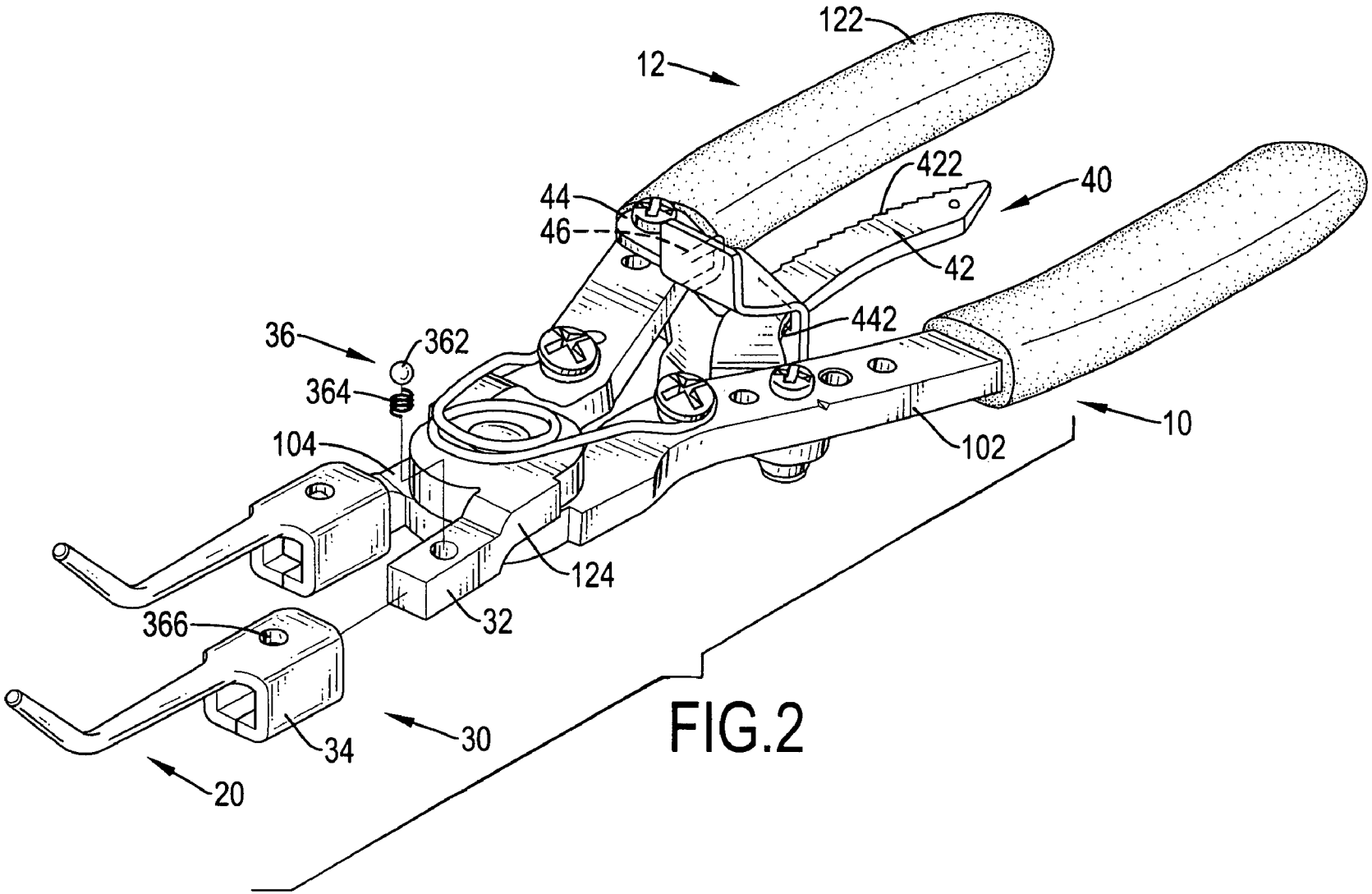
FIG. 2 is an exploded perspective view of the pliers in FIG. 1.
Figure 3:
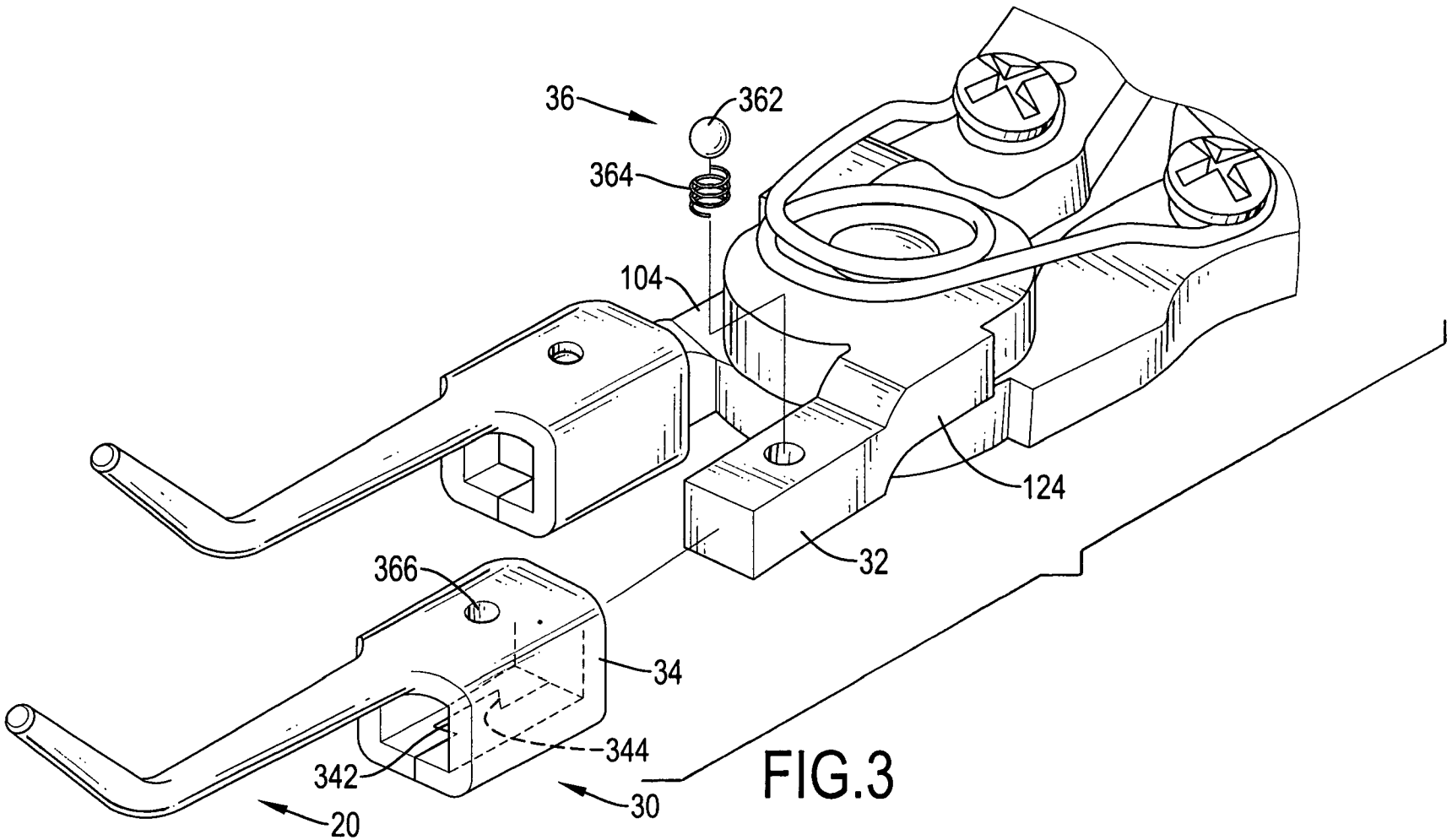
FIG. 3 is an enlarged exploded perspective view of the connection device of the pliers in FIG. 2.

With further reference to FIGS. 2 and 3, the connection devices (30) are mounted between the heads (20) and the shanks (104,124) to detachably connect the heads (20) to the shanks (104,124). Each connecting device (30) comprises a connecting block (32), a connection loop (34) and a positioning device (36).

The connecting block (32) is formed on one of the heads (20) and shanks (104,124), in a first embodiment as shown in FIG. 1, the connecting block (32) is formed on the shank (104,124) of one of the bodies (10,12). The connecting loop (34) is formed on a corresponding one of the heads (20) and shanks (104,124) and is securely and detachably mounted around the connecting block (32). In the first embodiment, the connecting loop (34) is formed on one of the heads (20). Each connecting loop (34) is formed from a tab having two ends connected with each other. One of the ends of the tab of the connecting loop (34) has an engaging tag (342), and the other end of the tab of the connecting loop (34) has an engaging recess (344) engaging the engaging tag (342). In a preferred embodiment, the engaging tag (342) and engaging recess (344) of the tab of the connecting loop (34) are dovetail-shaped. With the engagement between the dovetail-shaped tag (342) and recess (344), the structural strength of the connecting loop (34) is improved. With the connecting loop (34) mounting around the connecting block (32), the head (20) is securely but detachably attached to a corresponding shank (104,124).

Figure 4:
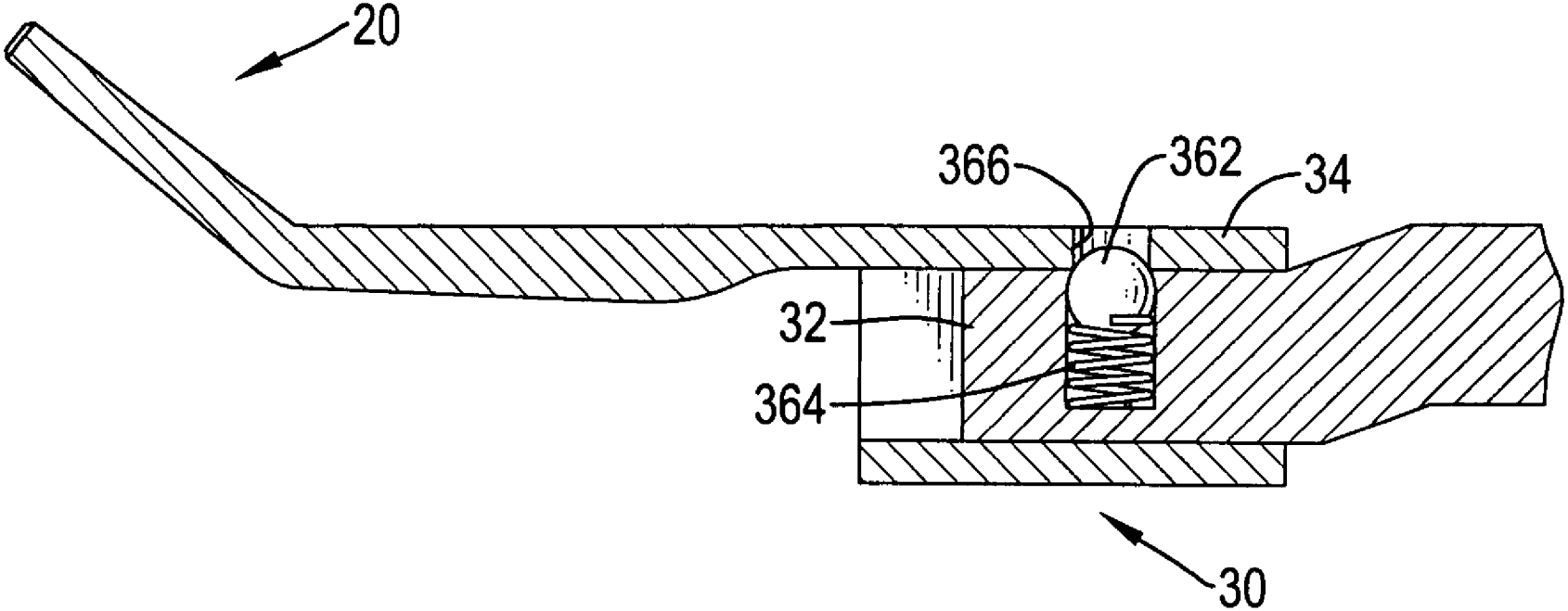
FIG. 4 is an enlarged side view in partial section of the connection device of the pliers in FIG. 3.

With further reference to FIG. 4, the positioning device (36) is mounted between the connecting block (32) and the connecting loop (34) and comprises a positioning ball (362), a spring (364) and a positioning hole (366). The positioning ball (362) is retractably mounted in a hole defined in the connecting block (32). The spring (364) is mounted in the hole in the connecting block (32) and supports the positioning ball (362). The positioning hole (366) is defined in the connecting loop (34) and engages the positioning ball (362). With the engagement between the ball (362) and the positioning hole (366), the combination of the connection block (32) and loop (34) is secure.

Accordingly, because the heads (20) are mounted on the shanks (104,124) of the bodies (10,12) with the connection devices (30), the heads (20) are easily detached from the shanks (104,124) to change different heads onto the shanks (104,124). Therefore, the pair of pliers in accordance with the present invention is convenient and versatile in use.

Figure 5:
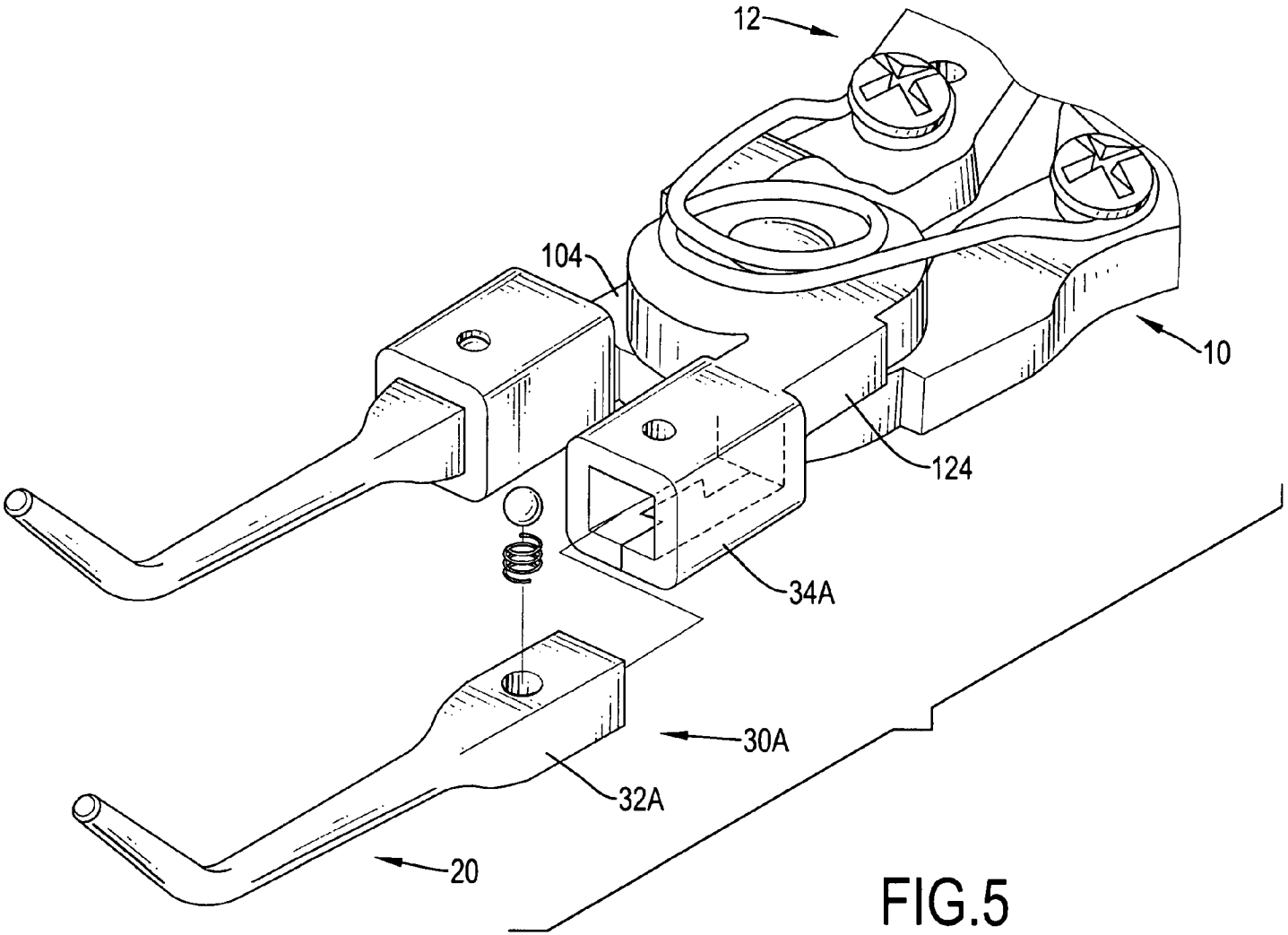
FIG. 5 is an enlarged exploded perspective view of an alternative embodiment of a connection device in accordance with the present invention.

With reference to FIG. 5, in an alternative embodiment, the connecting blocks (32A) of the connecting devices (30A) are formed respectively on the heads (20), and the connecting loops (34A) of the connecting devices (30A) are formed respectively on the shanks (104,124) of the first and second bodies (10,12).

Figure 6:
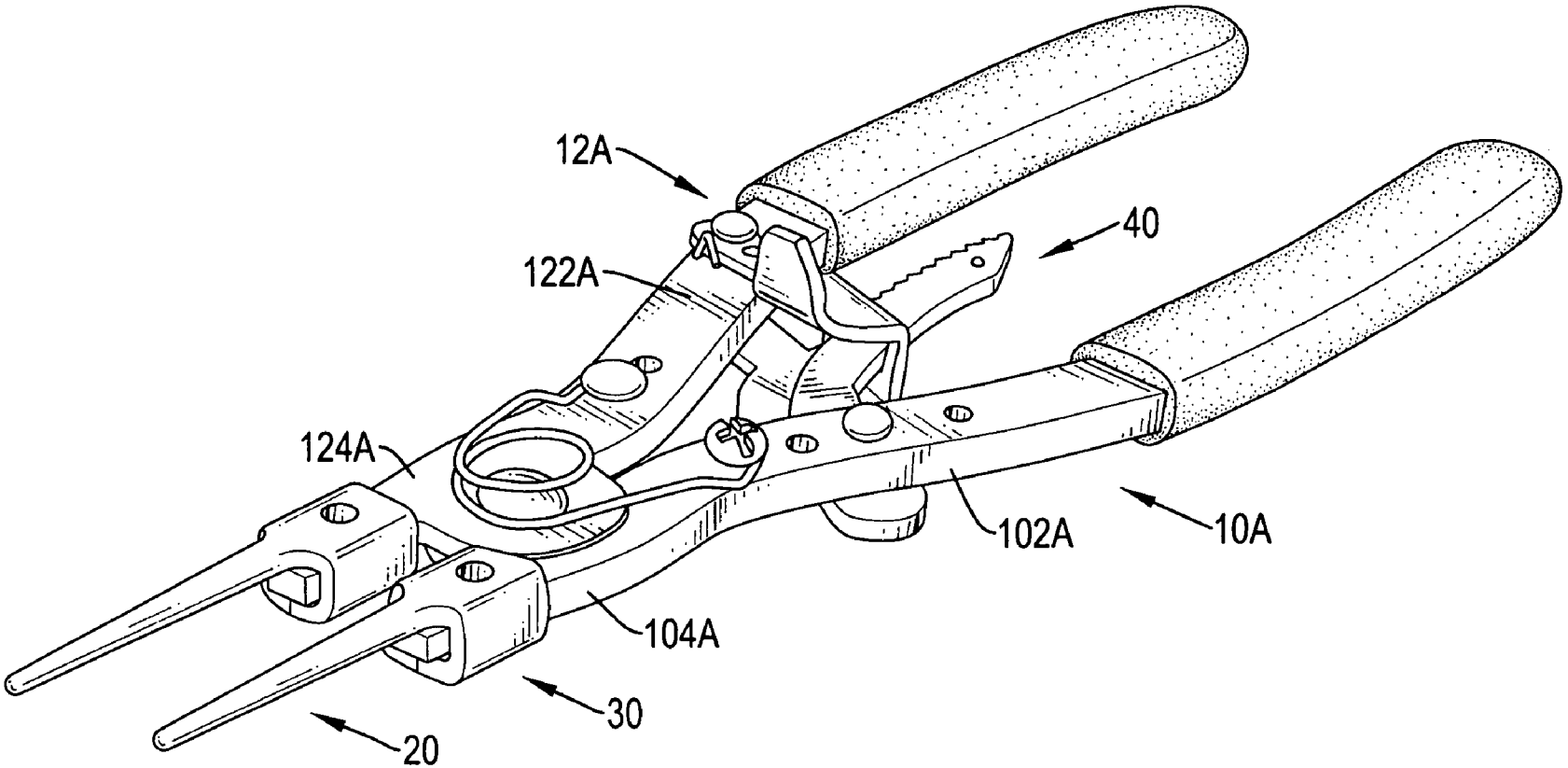
FIG. 6 is a perspective view of a second embodiment of a pair of pliers in accordance with the present invention.
Figure 7:
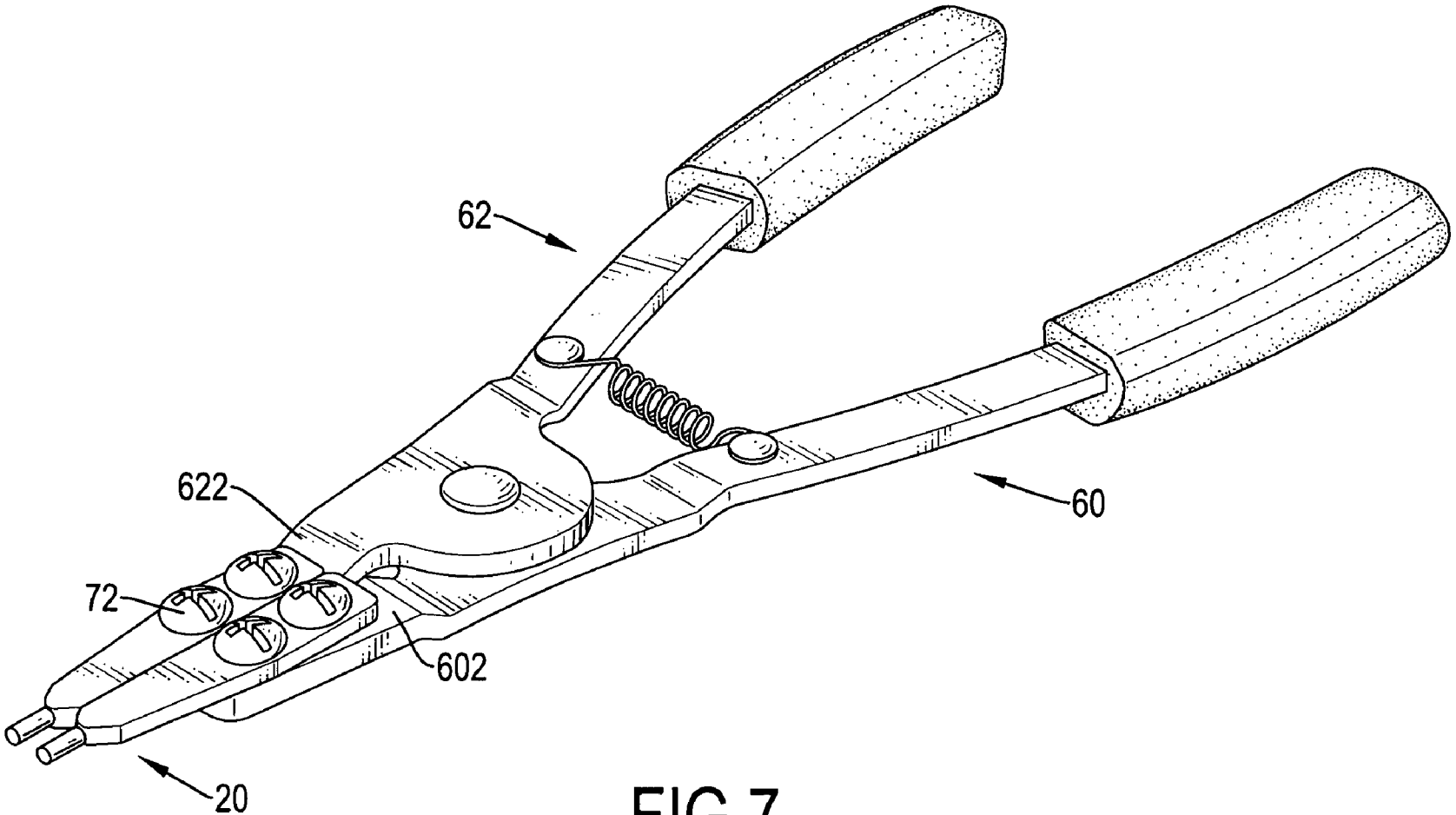
FIG.7 PRIOR ART
FIG. 7 is a perspective view of a pair of conventional pliers in accordance with the prior art.

In addition, the handle (102,122) and shank (104,124) of each body (10,12) can locate at opposite side of the pliers as shown in FIG. 1, such that the shanks (104,124) will be expanded when the handles (102,122) are pushed. In a second embodiment, with reference to FIG. 6, the handle (102A, 122A) and shank (104A,124A) of each body (10A,12A) can locate at same side of the pliers, such that the shanks (104A, 124A) will be expanded when the handles (102A,122A) are pulled.

Additionally, with reference to FIGS. 1 and 2, the pair of pliers further comprises a holding device (40) mounted between the handles (102,122) of the first and second bodies (10,12) to hold the shanks (104,124) at different expansion position. The holding device (40) comprises a curved tongue (42), a holding bracket (44) and a biasing member (46). The curved tongue (42) is securely attached to the handle (102) of the first body (10) and has multiple teeth (422) formed on the curved tongue (42) at an edge facing the second body (12). The holding bracket (44) is pivotally attached to the handle (122) of the second body (12) and has a slot (442) defined through the holding bracket (44) and having an inner edge. The curved tongue (42) extends slidably through the slot (442) in the holding bracket (44) and may have a knob formed on the curved tongue (42) to keep the curved tongue (42) from being completely extending out from the slot (442) in the holding bracket (44). The biasing member (46) may be a torsion spring, is mounted on the handle (122) of the second body (12) and provides a force to push the inner edge of the slot (442) engaging the teeth (422) on the curved tongue (42).

With the engagement between the slot (442) and the teeth (422) on the curved tongue (42), the handles (102,122) and the shanks (104,124) of the bodies (10,12) will be held at specific expansion position to allow a user to operate the pliers at this position. Additionally, when the holding bracket (44) is pivoted downward relative to the second body (12), the slot (442) will be disengage from the teeth (422) on the curved tongue (42) so that the handles (102,122) of the bodies (10, 12) can be pulled away from each other even to a full expansion condition.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pair of pliers comprising:

a first body having a handle and a shank formed respectively at two ends of the first body;

a second body pivotally connected with the first body and having a handle and a shank formed respectively at two ends of the second body;

a pair of heads detachably attached respectively to the shanks of the first and second bodies; and two connection devices mounted between the heads and the shanks to detachably connect the heads to the shanks, and each connecting device comprising a connecting block formed on one of the heads and shanks; and a connecting loop formed on a corresponding one of the heads and shanks and securely and detachably mounted around the connecting block, wherein each connecting loop is formed from a tab having two ends connected with each other;

one of the ends of the tab of each connecting loop has an engaging tag, and the other end of the tab of the connecting loop has an engaging recess engaging the engaging tag; and the engaging tag and engaging recess of the tab of each connecting loop are dovetail-shaped.

2. The pliers as claimed in claim 1, wherein the connecting blocks of the connecting devices are formed respectively on the shanks of the first and second bodies; and the connecting loops of the connecting devices are formed respectively on the heads.

3. The pliers as claimed in claim 2, wherein each connection device further comprises a positioning device having a positioning ball retractably mounted on the connecting block of the connecting device;

a spring mounted in the connecting block of the connecting device and supporting the positioning ball; and a positioning hole defined in the connecting loop of the connecting device and engaging the positioning ball.

4. The pliers as claimed in claim 1, wherein the connecting blocks of the connecting devices are formed respectively on the heads; and the connecting loops of the connecting devices are formed respectively on the shanks of the first and second bodies.

5. The pliers as claimed in claim 4, wherein each connection device further comprises a positioning device having a positioning ball retractably mounted on the connecting block of the connecting device;

a spring mounted in the connecting block of the connecting device and supporting the positioning ball; and a positioning hole defined in the connecting loop of the connecting device and engaging the positioning ball.

6. The pliers as claimed in claim 1 further comprising a holding device mounted between the handles of the first and second bodies and comprising a curved tongue securely attached to the handle of the first body and having multiple teeth formed on the curved tongue at an edge facing the second body;

a holding bracket pivotally attached to the handle of the second body and having a slot defined through the holding bracket and having an inner edge, wherein the curved tongue extends slidably through the slot in the holding bracket; and a biasing member mounted on the handle of the second body and providing a force to push the inner edge of the slot engaging the teeth on the curved tongue.

7. The pliers as claimed in claim 2 further comprising a holding device mounted between the handles of the first and second bodies and comprising a curved tongue securely attached to the handle of the first body and having multiple teeth formed on the curved tongue at an edge facing the second body;

a holding bracket pivotally attached to the handle of the second body and having a slot defined through the holding bracket and having an inner edge, wherein the curved tongue extends slidably through the slot in the holding bracket; and a biasing member mounted on the handle of the second body and providing a force to push the inner edge of the slot engaging the teeth on the curved tongue.

8. The pliers as claimed in claim 3 further comprising a holding device mounted between the handles of the first and second bodies and comprising a curved tongue securely attached to the handle of the first body and having multiple teeth formed on the curved tongue at an edge facing the second body;

a holding bracket pivotally attached to the handle of the second body and having a slot defined through the holding bracket and having an inner edge, wherein the curved tongue extends slidably through the slot in the holding bracket; and a biasing member mounted on the handle of the second body and providing a force to push the inner edge of the slot engaging the teeth on the curved tongue.

9. The pliers as claimed in claim 4 further comprising a holding device mounted between the handles of the first and second bodies and comprising a curved tongue securely attached to the handle of the first body and having multiple teeth formed on the curved tongue at an edge facing the second body;

a holding bracket pivotally attached to the handle of the second body and having a slot defined through the holding bracket and having an inner edge, wherein the curved tongue extends slidably through the slot in the holding bracket; and a biasing member mounted on the handle of the second body and providing a force to push the inner edge of the slot engaging the teeth on the curved tongue.

10. The pliers as claimed in claim 5 further comprising a holding device mounted between the handles of the first and second bodies and comprising a curved tongue securely attached to the handle of the first body and having multiple teeth formed on the curved tongue at an edge facing the second body;

a holding bracket pivotally attached to the handle of the second body and having a slot defined through the holding bracket and having an inner edge, wherein the curved tongue extends slidably through the slot in the holding bracket; and a biasing member mounted on the handle of the second body and providing a force to push the inner edge of the slot engaging the teeth on the curved tongue.

* * * * *